US005723263A

United States Patent [19]

Singer et al.

[11] Patent Number: 5,723,263

[45] Date of Patent: Mar. 3, 1998

[54] COLOR NEGATIVE ELEMENT HAVING IMPROVED BLUE RECORD PRINTER COMPATIBILITY

[75] Inventors: Stephen Paul Singer, Spencerport; Paul Barrett Merkel; Jeffrey Walter Schmoeger, both of Rochester, all of N.Y.

[73] Assignee: Eastman Kodak Company, Rochester, N.Y.

[21] Appl. No.: 748,067

[22] Filed: Nov. 12, 1996

Related U.S. Application Data

[63] Continuation of Ser. No. 430,639, Apr. 28, 1995, abandoned.

[51] Int. Cl.[6] ..... G03C 7/46

[52] U.S. Cl. ..... 430/374; 430/376; 430/389; 430/378; 430/379; 430/407; 430/359; 430/504; 430/508

[58] Field of Search ..... 430/502, 503, 430/504, 505, 506, 508, 509, 543, 557, 378, 379, 388, 389, 407, 376, 374, 359

[56] References Cited

U.S. PATENT DOCUMENTS

| | | | |
|---|---|---|---|
| 5,336,591 | 8/1994 | Yamamoto et al. | 430/557 |
| 5,391,443 | 2/1995 | Simons et al. | 430/503 |
| 5,447,831 | 9/1995 | Singer et al. | 430/504 |

*Primary Examiner*—Geraldine Letscher
*Attorney, Agent, or Firm*—Arthur E. Kluegel

[57] ABSTRACT

A multicolor negative photographic element comprises a support bearing a blue light-sensitive silver halide emulsion first layer and a green light-sensitized silver halide emulsion second layer wherein said second layer contains a dye sensitized to green light and wherein said first layer has associated therewith a hue correction coupler which upon coupling with oxidized developer produces a dye having a maximum absorbance in the range of 460 to 510 nm. so that the element has a D480/D440 density ratio which is greater than that exhibited by the element without the hue correction coupler. The invention also encompasses a blue sensitive silver halide emulsion layer associated with the hue correction coupler and a method of forming an image in the photographic element of the invention.

8 Claims, No Drawings

COLOR NEGATIVE ELEMENT HAVING IMPROVED BLUE RECORD PRINTER COMPATIBILITY

This is a Continuation of application Ser. No. 08/430,639, filed Apr. 28, 1995, now abandoned.

FIELD OF THE INVENTION

This invention relates to a color negative photographic element containing a coupler associated with a blue sensitive layer which produces a dye of peak absorbance in the range of 460–510 nm. after reaction with oxidized color developer which thereby improves printer compatibility.

BACKGROUND OF THE INVENTION

The color negative-positive photographic system relies on the exposure of a scene onto a color negative film. The exposed negative is then projected onto a negative-working color photographic paper to form, after development, the desired positive image in the form of a color reflective print. In order to correctly expose the photographic paper, the average density of the negative in all three color records (red, green and blue) must be measured so that the exposure time and balance between the amounts of the red, green and blue light used to expose the paper can be adjusted.

The general practice in the photofinishing industry is to scan the average color density of the negative using red, green and blue filters. There is no uniform standard for these filters. Different sets of filters may read the same negative differently because of variations in the amount of light they see. In most cases, this is not a problem since the response of a printer filter set is accounted for in the calculation of the subsequent exposure of the paper. However, this method assumes that the measured red, green and blue densities of any and all negatives, as read by a particular printer system, reflect the actual color densities in each negative.

Color negative films are considered to be "printer compatible" on a particular printer, if they yield final photographic prints with acceptable color balance differences for any given scene. It is desirable in the photofinishing industry to always produce prints that are correct in color balance regardless of the type or composition of the negative element and regardless of the exposure level of the element. In order to fully accomplish color balance, it would be required that all negatives give equal response in density, as read by both the printer (using its filter set) and the photographic paper onto which the negative will be printed. It follows that it would then be necessary to have all negatives give identical density on a wavelength-by-wavelength basis through the entire exposure scale from minimum to maximum exposure.

In practice, this does not occur. There are wide variations in the wavelength-by-wavelength density (spectrophotographic) response of different negative elements as seen by the photofinishing trade. Negatives from different commercial sources often use entirely different couplers which have different spectrophotographic responses. In addition, different couplers may undergo different amounts and types of aggregation and other hue shifting phenomena as a function of exposure, thus causing shifts in density at any particular wavelength of the negative throughout the exposure scale. Moreover, it is common that different couplers of the same general hue but not identical hue are used in a single color record. For example, a typical layer may consist of an image coupler and an image modifier which form different dyes of the same general class. If the different dyes that are formed are not identical, then shifts in overall hue can occur as a function of exposure due to differences in activity between the various couplers. Finally, and most importantly in this invention, different levels of stains or unwanted sources of color can be retained, formed or introduced into the film during processing depending on the components of the film and so, different negatives will vary spectrophotometrically from each other.

The blue sensitive record presents printer compatibility problems unlike those presented by the green sensitive record. For example, the blue wavelength of maximum scanner response is often significantly offset from the peak sensitivity of the paper. On the other hand, the green record compatibility problems arise more from the shape or bandwidth of the absorption curves. Further, while the various manufacturers employ essentially the same spectral sensitivity for the green record of their color paper, the blue record varies significantly between manufacturers.

The variations in the blue record as seen by the printer may be viewed as (1) those which occur as a function of exposure level for a given blue record; for example, because of differences in hue between two yellow dyes formed from two different couplers and (2) those which occur as a function of the variation in the chemical constitution of different photographic elements; for example, imagewise stains or dye aggregation. Either of these variations in wavelength-by-wavelength density response between negatives is a particular problem in the blue record. Commercially available photographic papers typically have maximum sensitivity to blue light between 470 nm and 480 nm because printer lamps produce insufficient amounts of light at around 440 nm relative to the amounts of green and red light. Commercially available color negative contain yellow couplers that produce dyes with maximum density at around 440 nm to 445 nm in order to prevent excessive green density response by the printer. Printers typically use blue filters which have their maximum sensitivity in the 440–445 nm range. Hence, it is desirable that all negative films have the same relationship between the density in the 440 nm region compared to the 480 nm throughout the entire exposure scale. If two negatives have different relationships between the 440 nm and 480 nm regions, then the resulting prints will have a different color balance because they cannot appear identical to both the printer and the paper simultaneously.

A significant contributor to the variations in the relationship between the 480 and 440 densities is the existence of stains caused by the retained green sensitizing dye after processing of the negative element. In this regard, retained green sensitizing dye typically absorbs broadly in the 510 nm region and contributes much more density at 480 nm than at 440 nm and is thus a major contributor to stain. Moreover, this stain is often anti-imagewise in that it is highest in the low development areas (where the sensitizing dye is still well absorbed to the silver surface and is not significantly removed during the development step) and lowest in the areas of high development (where the sensitizing dye is partly removed from the surface during development and has ample opportunity to wash out even prior to fixing). If the sensitizing dye is removed from the silver surface to a greater extent during the development step, that leaves less dye that must be removed during the fixing step and improves the overall removal process. Even when the green layer is not exposed or developed (as in red or blue exposures), the stain due to the green sensitizing dye still tends to be anti-imagewise because of the effects of the nearby developing layers. Thus, different films can retain different amounts of green sensitizing dye not only between films of different types, but also across the exposure scale. This will result in variations in the ratio or density at 480 nm relative to 440 nm and in the color balance of the subsequent prints not only between different films but also as the exposure in the negative varies.

Thus variations in the differences in density at 440 nm and 480 nm between different negatives or within the exposure scale of a particular negative can cause variations in the color balance of the ultimate prints. The stain due to retained green sensitizing dye varies in an anti-imagewise manner, with the extent of the problem decreasing with increasing exposure level.

In order to get color prints with matched color balance from films which differ in their response between the 440 nm and 480 nm regions, some photofinishers must either segregate the different films so that the correct calculation of the exposure for that particular film can be made, or photofinishers can manually adjust the color balance during the printing operation. These operations are undesirable, leading to higher operating costs, decreased printer output and increased chance of operator error. In printers where segregation is not used (single channel printers) it is impossible to simultaneously generate acceptable/optimized prints on all films. It would be desirable to have color negative films which can be printed in different printers without segregating them from other films or manually adjusting color balance, and still obtain paper prints with good color balance.

It is known that photographically inert colorants can be added to photographic elements in order to adjust the printer response. For example, both U.S. patent application Ser. No. 08/075,068 filed Jun. 10, 1993 and U.S. Pat. No. 5,238,797 describe the use of photographically inert colorants with peak absorbance of greater than 560 nm to improve printer compatibility. However, this method is limited because the correction is not imagewise. The amount of density provided by the inert dye is fixed and constant throughout the exposure scale. At high exposures, the amount of correction will be insufficient, whereas at low exposures, the correction will be excessive. Only at one point in the exposure scale will the degree of correction be ideal. In addition, these inert colorants are too bathochromic (maximum absorbances greater than 560 nm) and do not address the forementioned problems in the blue record, namely in the 440 to 480 nm region.

U.S. patent application Ser. No. 08/139,238 filed Oct. 19, 1993 describes the use of a hue correction coupler which gives a dye after development with maximum absorbance greater than 560 nm to improve printer compatibility with respect to the green record when using magenta couplers with insufficient density in the 560–580 nm region relative to 550 nm. U.S. Pat. No. 5,270,156 describes combinations of 1-pentachlorophenyl-4-azophenyl-5-pyrazolone masking couplers with pyrazolotriazole magenta image couplers to minimize color variations in the final print. However, these materials affect the green record (ca 530 nm–590 nm) and do not address the forementioned problems in the blue record, namely in the 440 to 480 nm region.

The printer compatibility problems caused by mismatches in density in different regions of the green record as described in the art cited above result primarily from the choice of magenta coupler and subsequently formed magenta dye. This magenta image-dye problem is one which worsens with increasing exposure levels because additional amounts of the magenta dye are then formed. On the other hand, the present concern with the yellow record is one which improves with increasing exposure levels. A significant portion of the blue record, particularly at low exposures, is due to the presence of retained green sensitizing dye which contributes more density at 450 nm than at 440 nm. This yellow colored specie is present in an anti-image fashion in that it contributes more blue density at 480 nm in low exposure areas and less in regions of high exposure. Thus, variations in the density at 480 nm relative to 440 nm are a problem not only between different films, but also across the exposure scale.

It is desired to provide a photographic element which does not exhibit poor printer compatibility due to the undesired 480 nm absorption of green sensitizing dye which remains in the film after processing.

SUMMARY OF THE INVENTION

The invention provides a multicolor negative photographic element comprising a support bearing a blue light-sensitive silver halide emulsion first layer and a green light-sensitized silver halide emulsion second layer wherein said second layer contains a dye sensitized to green light and wherein said first layer has associated therewith a hue correction coupler which upon coupling with oxidized developer produces a dye having a maximum absorbance in the range of 460 to 510 nm. so that the element has a D480/D440 density ratio which is greater than that exhibited by the element without the hue correction coupler. The invention also encompasses a blue sensitive silver halide emulsion layer associated with the hue correction coupler of the invention and a method of forming an image in the photographic element of the invention.

The invention provides a photographic element which does not exhibit poor printer compatibility due to the undesired 480 nm absorption of green sensitizing dye which remains in the film after processing.

DETAILED DESCRIPTION OF THE INVENTION

The objective of less variation in the blue record as detected by a printer can be obtained in a film that does not contain sufficient density at 480 nm relative to the density at 440 nm by additionally providing in the film a coupler (subsequently designated as a hue correction coupler) that will form a dye with a peak absorption between 460–510 nm after processing. As a result, the blue density of such films appears more alike to both printers and photographic paper relative to other films that have sufficient density at 480 nm and remain constant across the exposure scale. This implies that the final paper images formed from any film negative will be more alike in overall color balance as seen by the photofinishing trade and consistent throughout the exposure scale.

Unless otherwise indicated, it will be understood that the density values are measured at a "neutral midscale exposure" of the film. For the purposes of this application, neutral midscale exposure refers to a neutral (that is, all three color records) exposure at +0.82 logE exposure units over the ISO speed of the element. This approximates the average density region (often referred to as a midscale exposure) of a correctly exposed negative.

The present invention has particular application in color photographic negatives of the foregoing type wherein D480/D440 of the element at neutral midscale exposure, absent the hue correction coupler, is 0.95 or less (particularly where D480/D440 is 0.9 or less or is even 0.85 or less). The hue correction coupler should provide an increase of D480/D440 under high exposure conditions of at least 0.06, and preferably at least 0.10 (and more preferably at least 0.15). The hue correction coupler should produce a dye that is not decolorized or removed during photographic processing of the negative. The half bandwidth ("HBW") of the dye formed from the hue correction coupler can be 20–200 nm, preferably between 50–150 nm. "HBW" is the width of the absorption peak at ½ maximum height. It is also preferred to keep any increase in green density which may be derived by the unwanted absorbance of the hue correction coupler to a minimum. In this regard, it is preferred that any increase of D550/D440 of the element at neutral midscale exposure, which is caused by the hue correction, is less than the amount the hue correction coupler increases D480/D440 at neutral midscale exposure.

It is preferred that the hue correction coupler and its subsequent dye be non-diffusible, that is during long term storage it preferably remains in the layer in which it is coated. This can be accomplished, for example, by ballasting the coupler or attaching it to a polymeric backbone. The range of density at 480 nm provided by the hue correction coupler should be between 0.001 and 2.0, preferably between 0.005 and 1.0. Suitably, the coated levels for the hue correction coupler would be between about 0.0002 $g/m^2$ and 5 $g/m^2$, or more suitably between about 0.001 $g/m^2$ and 2 $g/m^2$, and more typically between 0.01 and 1 $g/m^2$. It is also highly desirable that the hue correction coupler have excellent stability, both in terms of thermal stability as well as stability towards light, so that the color balance position of the negative does not alter with time.

The hue correction coupler is associated with a blue sensitive layer (located in, or adjacent to, a blue sensitive layer). When two or more layers of different sensitivity to blue light are present, it is preferred that the hue correction coupler is present in the blue layer that is the primary contributor to the density region which needs additional density in the 480 nm region. For instance, if the density at 480 nm needs to be increased in regions of high exposure, then it is preferred to be located in the less sensitive layer. If the density at 480 nm needs to be increased in regions of low exposure, then it would be preferred to be located in the most sensitive blue layer. Any other type of coupler such as masking couplers, development inhibitor releasing couplers, bleach accelerator releasing couplers, etc known in the art may also be present along with the hue correction coupler.

The hue correction coupler can also release any photographically useful group known in the art upon reaction with oxidized developer and thus, serve additional functions beyond hue correction. Examples of photographically useful groups include, but are not limited to, development inhibitors, either directly or indirectly through a timing group, azo groups, bleach accelerators, development accelerators, electron transfer agents, bleach inhibitors, etc.

The hue correction coupler of the invention may be introduced into the film element by any method known in the art, such as oil in water dispersions, polymers, solid particles or latexes such as described in Research Disclosures identified later in this application. The hue correction coupler may also be co-dispersed with another coupler. It should also be appreciated that the peak absorbance of the dye formed from a hue correction coupler may be highly dependent on environment and as such, may be manipulated to give the desired density requirements by appropriate choice of coupler solvent, addenda, and dispersion conditions.

As already mentioned, the present invention provides a means to adjust developed negatives which have low density in the 480 nm region relative to the 440 nm region to a higher D480/D440 ratio. Consequently, negatives of the present invention can contain any type of yellow coupler or combination of yellow couplers which forms a blue record with relatively low absorption in the 480 nm range upon reaction with oxidized color developer (for example, with a D480/D440 at a neutral midscale exposure of 0.95 or less). Negative elements of the present invention particularly contain as a yellow image dye-forming coupler, either an acylacetamide (such as those described in EP 0,447,969A1), including an acylacetoanilide (such as described in U.S. Pat. No. 5,118,599) or a malondianilide (such as described in EP 0,482,552A1). It is preferred that these yellow image couplers are two equivalent, that is, contain a coupling-off group that is released upon reaction with oxidized developer.

While the particular formula of the hue correction coupler employed is not critical to the invention apart from the need to maintain the desired photographic properties, the following are examples of suitable hue correction couplers for use in the invention:

HCC-1

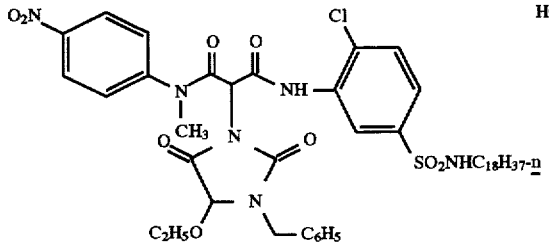

HCC-2

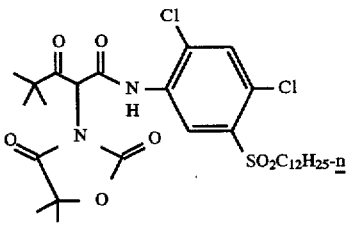

HCC-3

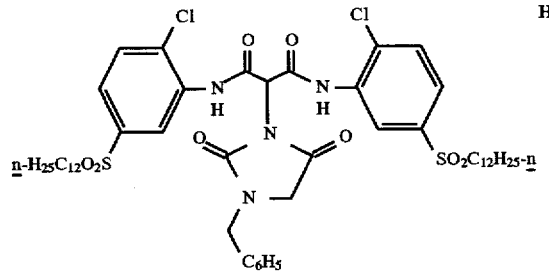

HCC-4

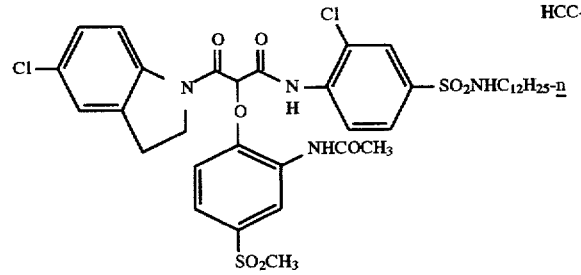

-continued

HCC-5

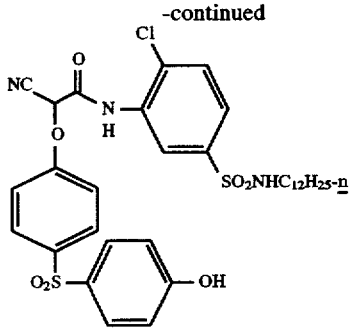

HCC-6

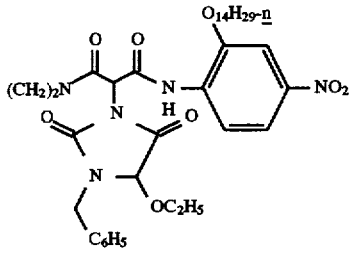

HCC-7

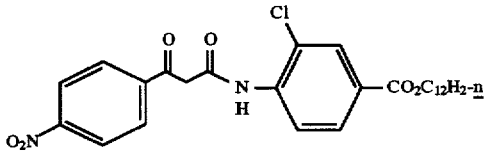

HCC-8

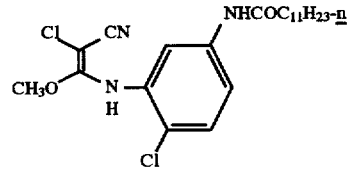

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobic or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps useful in conjunction with the invention are described in *Research Disclosure*, item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

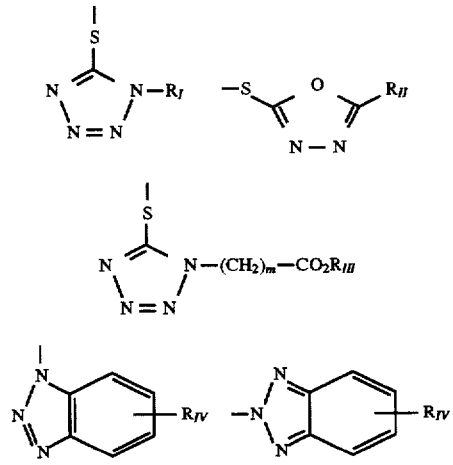

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

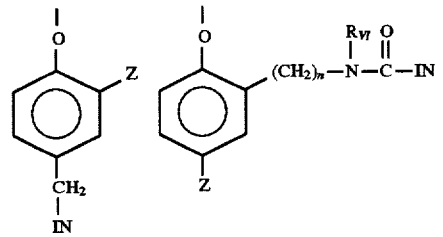

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

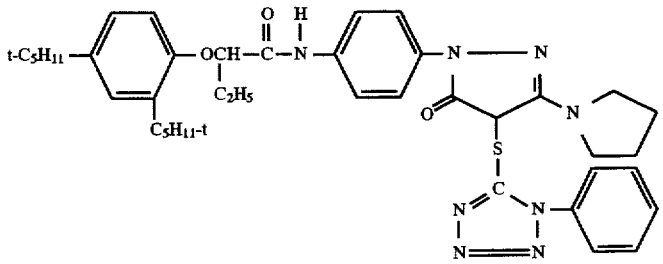

D2

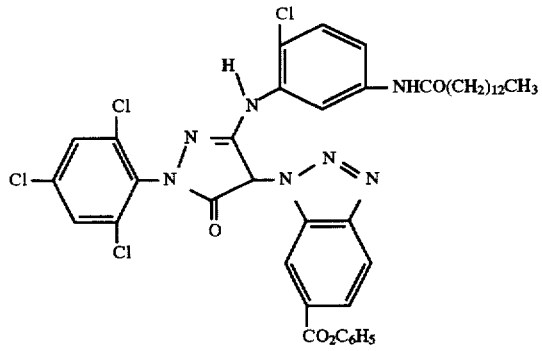

-continued
D3
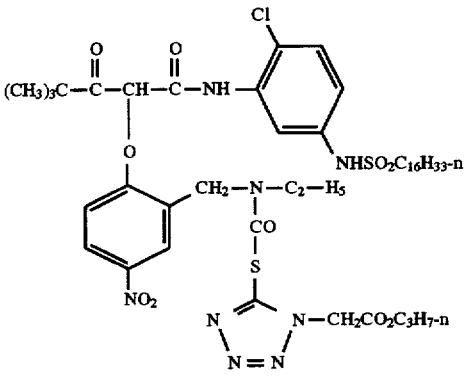
D4
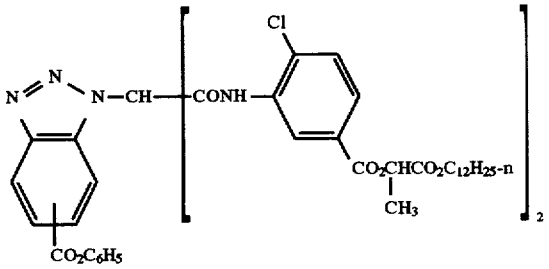
D5
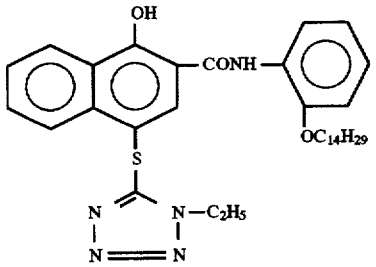
D6
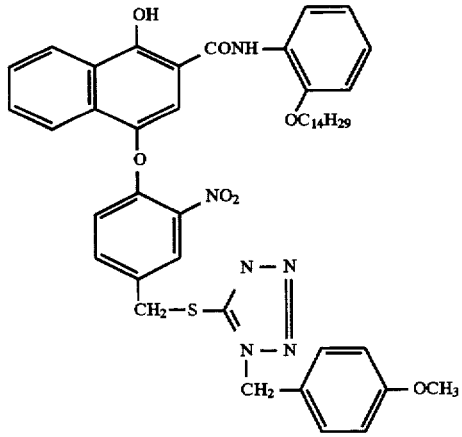

-continued
D7
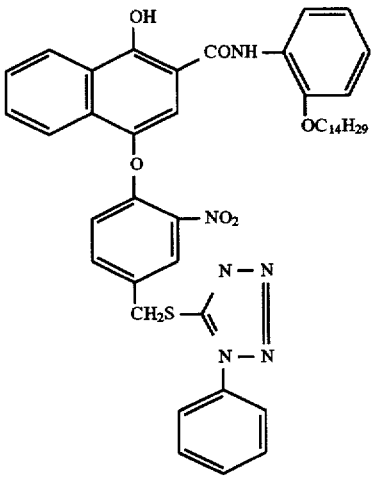
D8
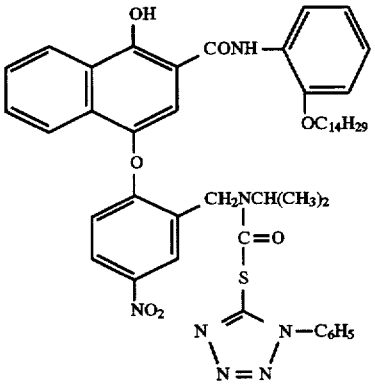
D9
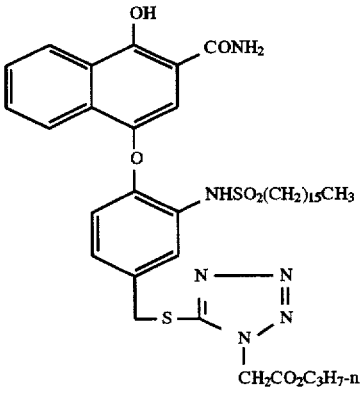

-continued

D10

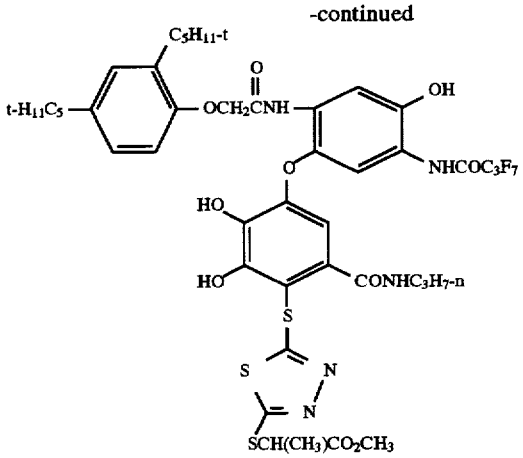

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various patents and other publications cited in this specification are incorporated herein by reference.

EXAMPLES

The invention is illustrated in the following single layer and multilayer examples.

Single layer photographic elements were prepared by coating a cellulose acetate-butyrate clear film support with gelatin at 3.77 g/m$^2$, a blue sensitized silver bromoiodide emulsion at 0.807 g/m$^2$ and a yellow image coupler at 1.076 g/m$^2$ (when coated alone) or at 0.699 g/m$^2$ when coated with the hue correction coupler at 0.377 g/m$^2$. This layer was then overcoated with a layer containing 2.70 g/m$^2$ of gelatin and bis-vinylsulfonyl methyl ether hardener at 1.75% weight percent based on total gel. All couplers were dispersed in their own weight of dibutylphthalate.

All of the wavelength measurements given are with reference to development of the element with 2-[(4-amino-3-methyl phenyl)ethylamino]ethanol, as typically used in the industry for development of negative films as in KODAK FLEXICOLOR II Process (British Journal of Photography Annual, 1988, pp 196–198). Samples of each element were exposed imagewise through a stepped density test object and subjected to the KODAK FLEXICOLOR II (C41) process as described in *British Journal of Photography Annual*, 1988, pp 196–198. Density and spectrophotographic measurements were taken at the indicated wavelength and/or exposure values. The ratio of density at 480 nm to density at 440 nm is a measure of the broadening of the yellow hue. In terms of exposure, low refers to measurements taken at the step with density closest to 0.15 above Dmin, medium at the step closest to density 1.0 above Dmin and high at maximum density.

TABLE I demonstrates that the addition of a hue correction coupler such as HCC-1 greatly increases the density of the blue record at 480 nm relative to 440 nm. This implies that the film that contains the hue correction coupler will simultaneously appear more alike to both the printer (reading ca. 440 nm) and the photographic paper (reading ca. 480 nm). The mere combination of two yellow couplers, even if one is bathochromic to the other, is not sufficient to adequately increase the density at 480 nm as do the hue correction couplers of this invention. Note that the addition of the bathochromic image couplers D or E do not raise the D480/D440 ratio of the hypsochromic image couplers B or C to that of Coupler A, whereas the addition of HCC-1 surpasses it.

TABLE I

HUE COMPARISON OF COUPLER COMBINATIONS

| Example | Type | Coupler | Second Coupler | $\lambda_{max}$ | D480/D440 |
|---|---|---|---|---|---|
| 1 | Comp | A | — | 448 | .771 |
| 2 | " | B | — | 448 | .732 |
| 3 | " | C | — | 445 | .670 |
| 4 | " | D | — | 457 | .856 |
| 5 | " | E | — | 452 | .809 |
| 6 | " | F | — | 451 | .712 |
| 7 | " | G | — | 453 | .838 |
| 8 | " | — | HCC-1 | 466 | 1.145 |
| 9 | " | B | A | 448 | .735 |
| 10 | " | B | D | 451 | .745 |
| 11 | Inv | B | HCC-1 | 452 | .814 |
| 12 | Comp | C | A | 446 | .700 |

TABLE I-continued

HUE COMPARISON OF COUPLER COMBINATIONS

| Example | Type | Coupler | Second Coupler | $\lambda_{max}$ | D480/D440 |
|---|---|---|---|---|---|
| 13 | " | C | D | 449 | .726 |
| 14 | | C | E | 447 | .729 |
| 15 | Comp | C | G | 447 | .695 |
| 16 | Inv | C | HCC-1 | 451 | .812 |

The structures of materials are as follows:

A

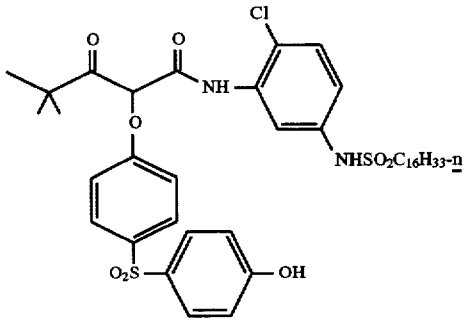

B

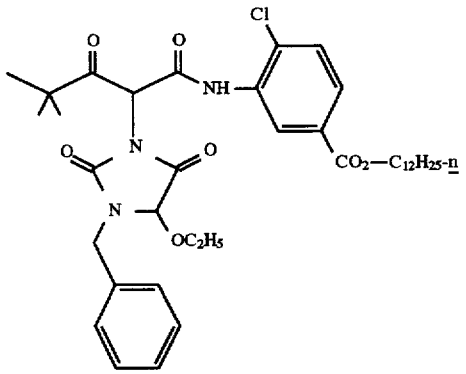

C

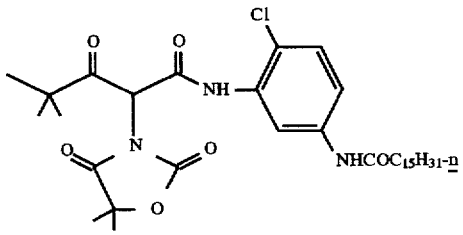

D

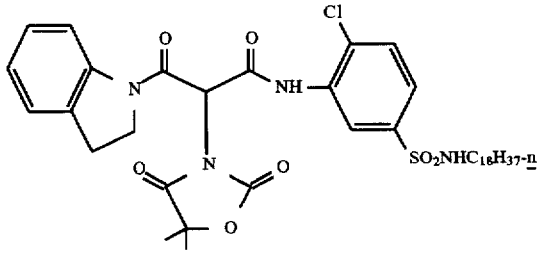

-continued

E

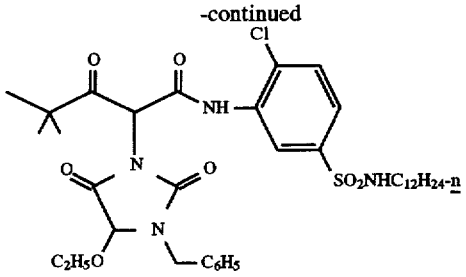

F

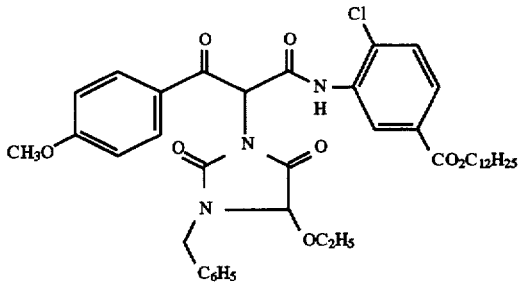

G

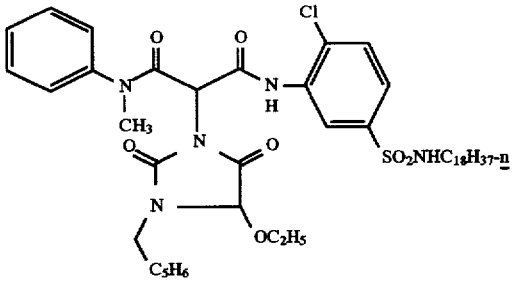

A multilayer film demonstrating some of the principles of this invention along with appropriate comparisons were prepared as follows:

Comparative Example 14 (CML-1)

A comparative multi-layer photographic element was produced by coating the following layers on a cellulose triacetate film support (coverages are in grams per meter squared, emulsion sizes are determined by the disc centrifuge method and are reported in Diameter×Thickness in microns);

Layer 1 (Antihalation layer): black colloidal silver sol at 0.140; gelatin at 2.15; OxDS-1 at 0.108, DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3×0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; gelatin at 1.72 and anti-foggant 4-hydroxy-6-methyl-1,3,3a,7-tetraazaindene at 0.010.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler M-1 at 0.258; gelatin at 1.08 and anti-foggant 4-hydroxy-6-methyl-1,3,3a,7-tetraazaindene at 0.005.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; Coupler M-1 at 0.086; MC-2 at 0.015; DIR-2 at 0.016; gelatin at 2.12 and anti-foggant 4-hydroxy-6-methyl-1,3,3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; Coupler M-1 at 0.059; MC-2 at 0.054 and DIR-3 at 0.003.

Layer 8 (Yellow filter layer): gelatin at 0.86; Carey-Lea finely divided silver at 0.043 and OxDS-2 at 0.054.

Layer 9 (Slow yellow layer): an equal blend of three blue sensitized (both with BSD-1) tabular silver iodobromide emulsions (i) 0.50×0.085, 1.5 mole % I (ii) 0.60 diameter, 3% mole I and (iii) 0.68 diameter, 3 mole % I at a total of 0.430; yellow dye forming coupler F at 0.699; yellow dye forming coupler B at 0.215; DIR-4 at 0.086; C-1 at 0.097 and gelatin at 2.066.

Layer 10 (Fast yellow layer): two blue sensitized (with YSD-1) tabular silver iodobromide emulsions (i) 3.1×0.137, 4.1 mole % I at 0.396 (ii) 0.95 diameter, 7.1 mole % I at 0.47; Coupler B at 0.131; Coupler F at 0.215; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis (vinylsulfonyl)methane hardener at 1.6% of total gelatin weight.

Surfactants, coating aids, emulsion addenda, sequestrants, lubricants, matte and tinting dyes were added to the appropriate layers as is common in the art.

This example represents an ISO 200 speed multilayer film with a mixture of two yellow image couplers (Couplers B and F—see TABLE 1) that have been used in some commercially available color negative materials. This film is deficient in density at 480 nm relative to 440 nm as compared to another yellow coupler (Coupler A—see TABLE 1) that has been used in other commercially available products.

Comparative Example 15 (CML-2)

Comparative Example 15 was prepared in a similar manner as Comparative Example 14, except that Dye-4 was added at 0.054 g/m$^2$ to layer 1 (the antihalation layer). Dye-4 is a photographically inert dye with λmax of 480 nm. This example represents a multilayer film with density added at 480 nm in a non-imagewise fashion. Note that Dye-4 is also present in some commercially available films. The effect was to increase the ratio at high exposure levels, but it also caused the ratio at low exposure levels to balloon undesirably thereby increasing the Δ to 0.153.

Comparative Example 16 (CML-3)

Comparative Example 16 was prepared in a similar manner as Example 14, except that comparative bathochromic yellow coupler G was added to slow yellow layer 9 at 0.161 and the level of Coupler F was adjusted to 0.054 g/m$^2$ so that the overall amount of yellow coupler was held constant. This change had a desirable effect in reducing the Δ but only to the extent of 0.004.

Comparative Example 17 (CML-4)

Comparative Example 17 was prepared in a similar manner as Example 14, except that comparative bathochromic yellow coupler G was added to layer 9 at 0.161 and the level of Coupler F was adjusted to 0.054 g/m$^2$ so that the overall amount of yellow coupler was held constant. Note that coupler G has the same structure as HCC-1 except for a nitro group. Without the nitro group, the coupler forms a dye without the desired bathochromic shift. Again an improvement in the Δ is obtained but only a slight one.

Inventive Example 18 (IML-1)

Inventive Example 18 was prepared in a similar manner as Example 14, except that HCC-1 was added to the slow blue layer 9 at 0.161 and the level of Coupler F was adjusted to 0.054 g/m$^2$ so that the overall amount of yellow coupler was held constant. Note that the correcting effect of the hue correction coupler of the invention was realized primarily at the high exposure level with little undesirable ballooning of the low exposure values.

The structures of the materials used in the above elements are as follows:

DYE-1:

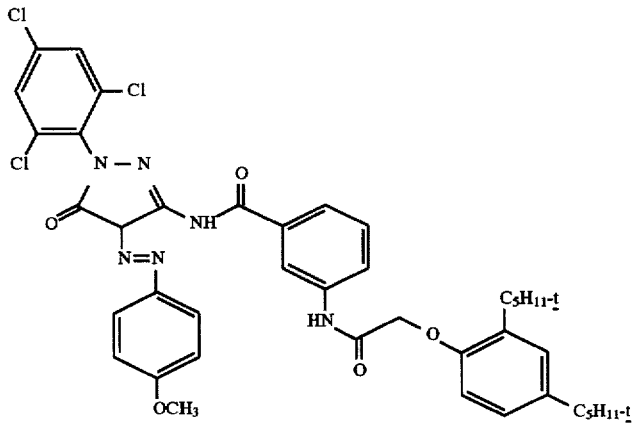

DYE-2:

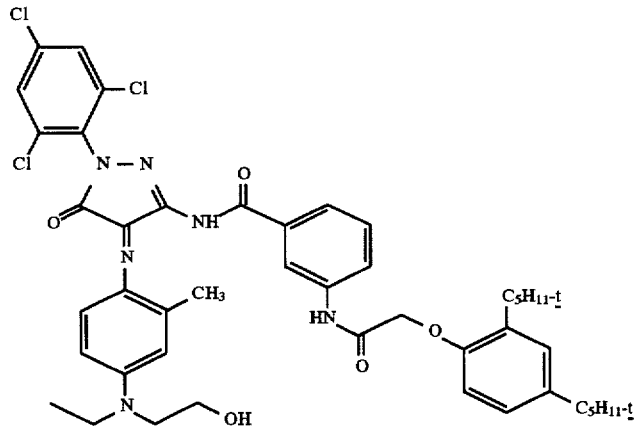

DYE-3:

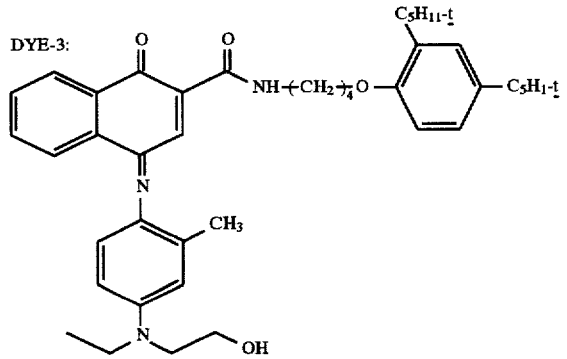

-continued
DYE-4:
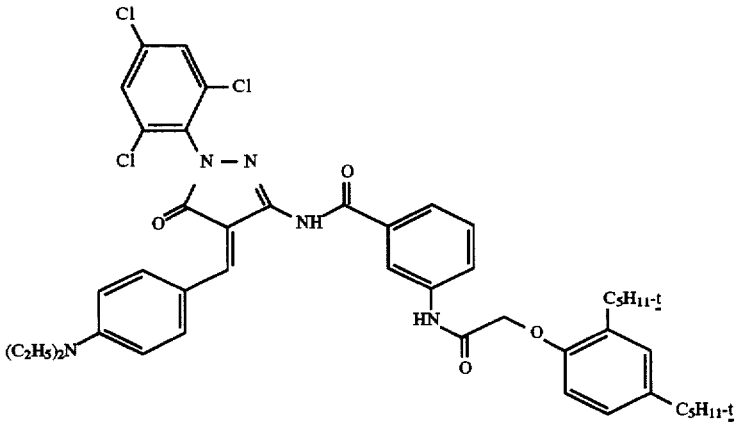
C-1:
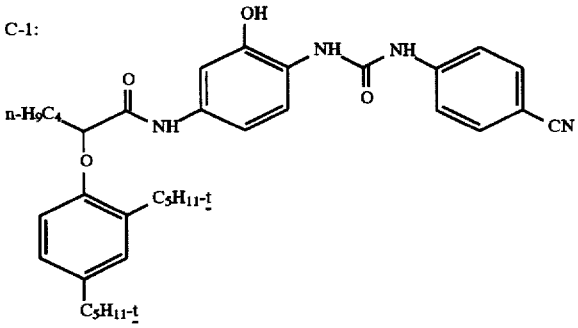
M-1:
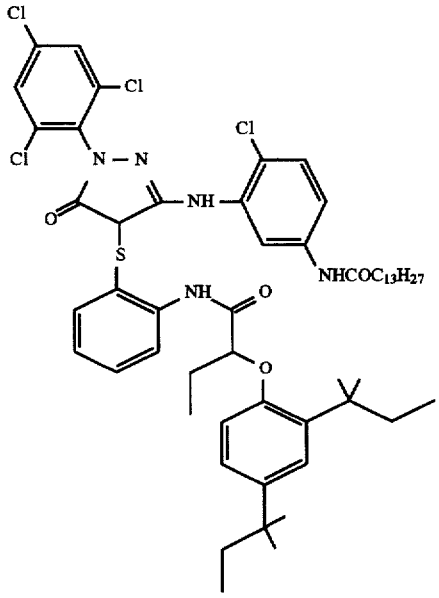
B:
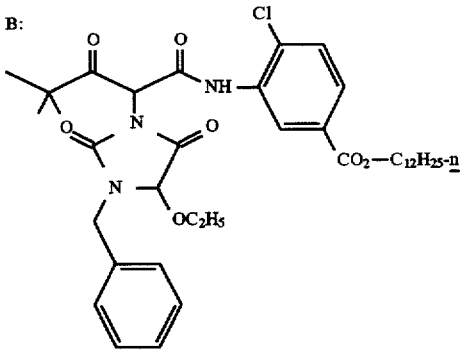
F:
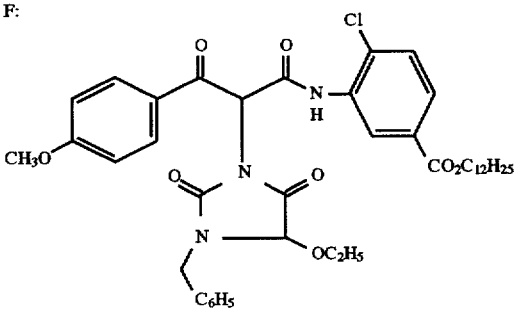

-continued
DIR-1:
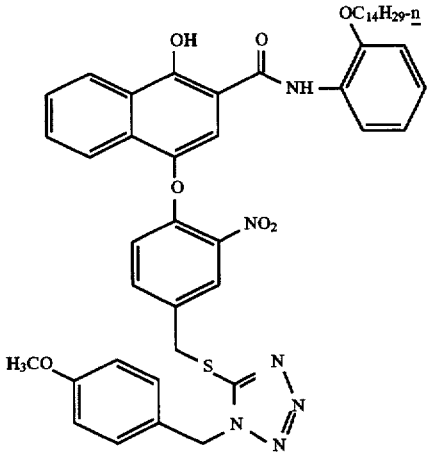
DIR-2:
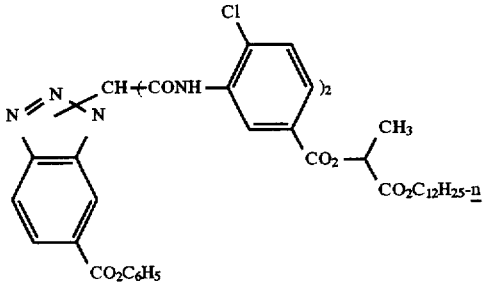
DIR-3:
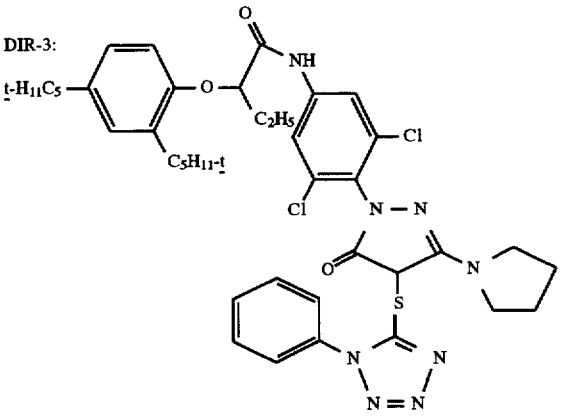
DIR-4:
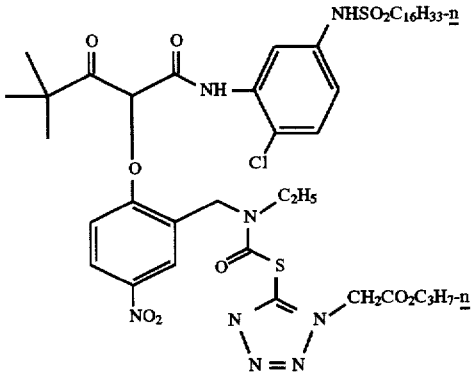
MC-1:
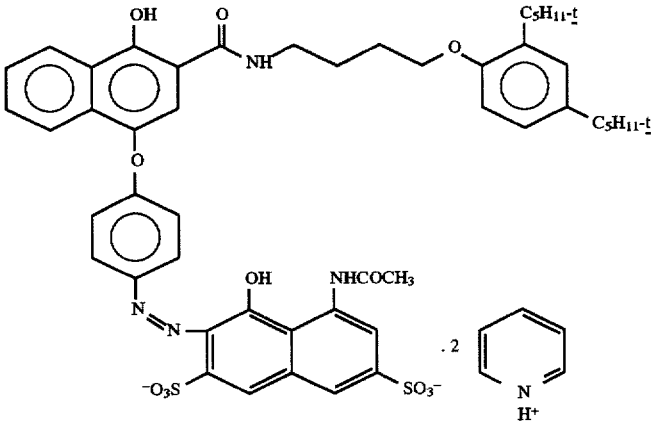

-continued
MC-2:
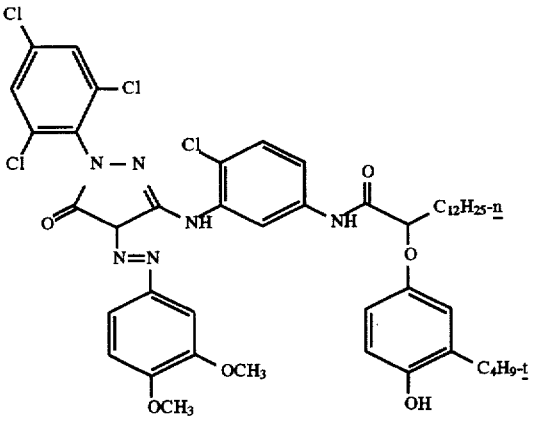
B-1:
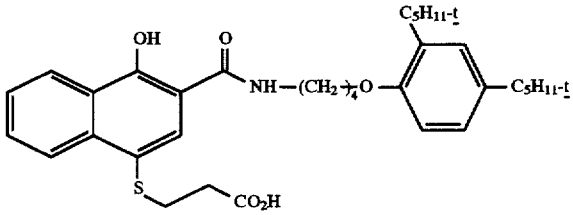
OxDS-1:
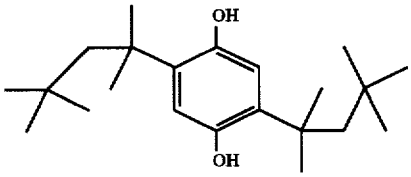
OxDS-2:
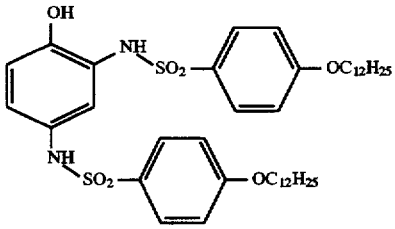
UV-1:
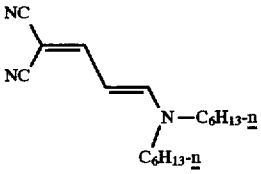
UV-2:
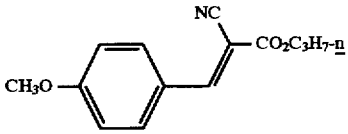
RSD-1:
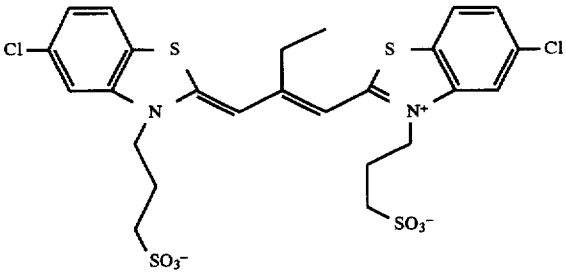
RSD-2:
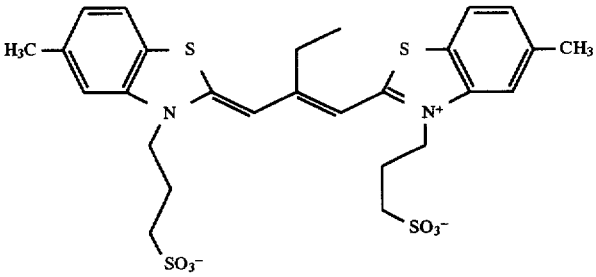

-continued

GSD-1:

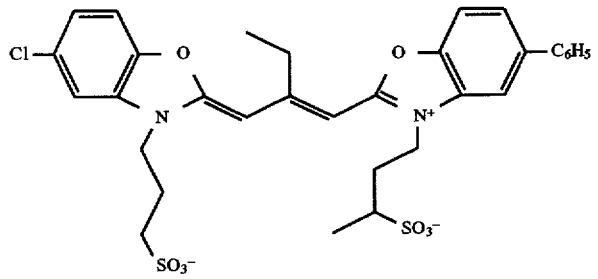

GSD-2:

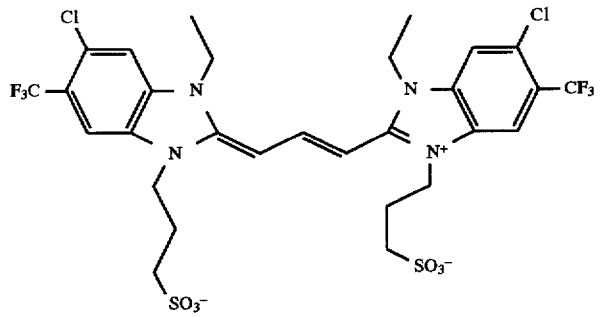

BSD-1:

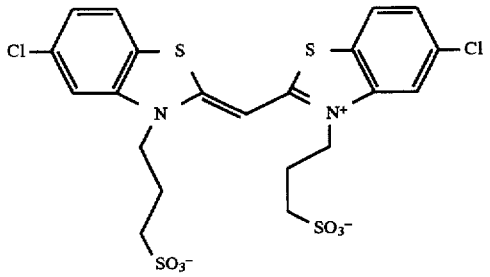

Comparative examples 1–13 are all commercially available from different photographic manufacturers. Note that test materials in comparative examples 14–17 and inventive example 18 are located in the slow yellow record. This will cause the effects of the test materials in this particular format to be most apparent only in the exposure region where that layer is developing, namely at high exposures. These multilayer film elements were given a stepped exposure of the blue layer only and processed as described for the single layers.

TABLE 2

D480/D440 RATIOS IN MULTILAYER FORMAT

| | | D480/D440 | | | |
|---|---|---|---|---|---|
| Example | Feature | ISO Speed | Low | High | Δ (L–H) |
| 1 | Mfr. 1 / Film 1 | 100 | .881 | .779 | .102 |
| 2 | Mfr. 1 / Film 2 | 200 | .871 | .821 | .050 |
| 3 | Mfr. 1 / Film 3 | 400 | .840 | .798 | .042 |
| 4 | Mfr. 1 / Film 4 | 1600 | .941 | .877 | .064 |
| 5 | Mfr. 1 / Film 5 | 100 | .928 | .845 | .083 |
| 6 | Mfr. 2 / Film 1 | 100 | .822 | .828 | –.006 |

TABLE 2-continued

D480/D440 RATIOS IN MULTILAYER FORMAT

| | | D480/D440 | | | |
|---|---|---|---|---|---|
| Example | Feature | ISO Speed | Low | High | Δ (L–H) |
| 7 | Mfr. 2 / Film 2 | 400 | .847 | .853 | –.006 |
| 8 | Mfr. 3 / Film 1 | 100 | .925 | .864 | .061 |
| 9 | Mfr. 3 / Film 2 | 400 | .791 | .815 | –.024 |
| 10 | Mfr. 4 / Film 1 | 100 | .858 | .811 | .047 |
| 11 | Mfr. 4 / Film 2 | 400 | .808 | .821 | –.013 |
| 12 | Mfr. 5 / Film 1 | 100 | .848 | .822 | .026 |
| 13 | Mfr. 5 / Film 2 | 400 | .881 | .821 | .060 |
| | Average of all 100 speed films | | .867 | .821 | .046 |
| | Average of all 400 speed films | | .833 | .822 | .011 |
| 14 | CML-1 | | .840 | .780 | .060 |
| 15 | CML-2 | | .989 | .836 | .153 |
| 16 | CML-3 | | .840 | .784 | .056 |
| 17 | CML-4 | | .841 | .785 | .056 |
| 18 | IML-1 | | .844 | .800 | .044 |

It is clear from commercial examples 1–13 in Table 2 that there is a high degree of variability in D480/D440 in commercially available products in terms of manufacturer and film speed as well as across the exposure scale within a particular film. The hue correction coupler of the invention would help reduce this differential if included in association with the blue sensitive layer.

Particular attention is directed to the multilayer data of Examples 14 to 18. Table 2 clearly demonstrates that a film containing the hue correction coupler of the invention in the least sensitive blue record increases density at 480 nm relative to density at 440 nm at high exposure and in an imagewise fashion. The 480 nm density undesirably provided by the green sensitizing dye diminishes with increasing exposure level. On the other hand, the hue correction coupler of the invention provides a 480 nm density which increases with exposure level. Thus the sum of the two effects remains relatively constant over the exposure range and helps to avoid color reproduction problems. The incorporation of the hue correction coupler in CML-1 to give IML-1 reduces the Δ. In addition, printing experiments using a KODAK Model 3510A printer, which is sensitive to variations in the 440–480 nm region, and KODAK EDGE photographic paper confirmed that Example 18, a multilayer film of the invention, gave prints that were more blue and closer in neutral hue (when compared to commercial examples containing bathochromic coupler A) relative to any of the comparison multilayers.

The present invention has been described in detail with particular reference to preferred embodiments, but it will be understood that variations and modifications can be effected within the spirit and the scope of the invention.

What is claimed is:

1. A process for forming a positive image on a negative working color photographic paper using the negative-positive photographic system, comprising:

forming a color negative image by exposing a color negative film element to the image, said element comprising a support bearing a blue light-sensitive silver halide emulsion first layer and a green light-sensitized silver halide emulsion second layer wherein said second layer contains a green sensitizing dye and wherein said first layer has associated therewith a hue correction coupler which upon coupling with oxidized developer produces a dye having a maximum absorbance in the range of 460 to 510 nm. and having a D480/D440 density ratio at mid scale which is greater than that exhibited by the element without the hue correction coupler; and then forming a positive color image reflective print by projecting said color negative image onto a negative-working color paper having a maximum blue sensitivity in the range of 470–480 nm using a printer that employs blue filters having a maximum sensitivity in the range of 440–445 nm.

2. The process of claim 1 wherein the coated level of said hue correction coupler is such that the element has a D480/D440 density ratio which is at least 0.06 greater than that exhibited by the element without the hue correction coupler.

3. The process of claim 2 wherein said density ratio is at least 0.10 greater than that exhibited by the element without the hue correction coupler.

4. The process of claim 3 wherein said density ratio is at least 0.15 greater than that exhibited by the element without the hue correction coupler.

5. The process of claim 1 wherein said photographic element contains at least two emulsion layers sensitive to blue light, said layers being respectively more and less light sensitive.

6. The process of claim 5 wherein the hue correction coupler is contained in the blue light sensitive layer which is less light sensitive.

7. The process of claim 1 wherein the hue correction coupler is represented by one of the formulas selected from the group consisting of:

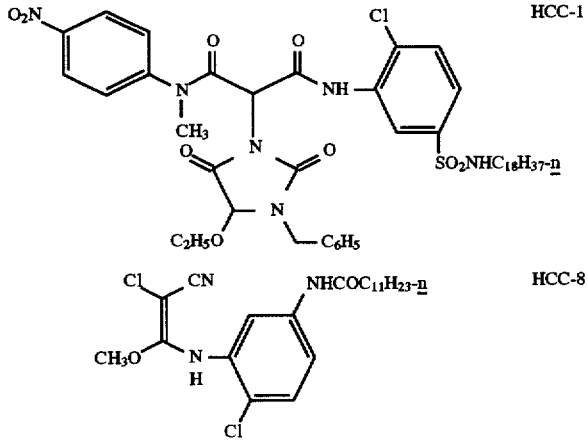

8. The process of claim 1 where the increase of D550/D440 of the element at neutral midscale exposure, which is caused by the addition of the hue correction coupler, is less than the amount that the addition of the hue correction coupler increases D480/D440 at neutral midscale exposure.

* * * * *